US007661622B2

(12) United States Patent
Hada et al.

(10) Patent No.: US 7,661,622 B2
(45) Date of Patent: Feb. 16, 2010

(54) APPARATUS AND METHOD FOR WINDING AND TRANSPORTING PAPER

(75) Inventors: Frank Stephen Hada, Appleton, WI (US); Paul Douglas Beuther, Neenah, WI (US); Allen Arthur Hammerstad, Appleton, WI (US); Mike John Rekoske, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 504 days.

(21) Appl. No.: 11/239,850

(22) Filed: Sep. 30, 2005

(65) Prior Publication Data

US 2007/0075178 A1 Apr. 5, 2007

(51) Int. Cl.
*B65H 20/06* (2006.01)

(52) U.S. Cl. ..... 242/535.4; 242/541.5

(58) Field of Classification Search ..... 242/533, 242/535, 535.4, 540, 541, 541.3, 541.4, 541.5, 242/542.3, 547; 226/173, 95, 97.4
See application file for complete search history.

(56) References Cited

U.S. PATENT DOCUMENTS

| | | | | |
|---|---|---|---|---|
| 1,248,542 | A | 1/1917 | Pope | |
| 3,743,199 | A | 7/1973 | Karr et al | |
| 4,087,319 | A | 5/1978 | Linkletter | |
| 4,143,828 | A | 3/1979 | Braun et al. | |
| 4,283,023 | A | 8/1981 | Braun et al. | |
| 4,883,233 | A | 11/1989 | Saukkonen et al. | |
| 4,921,183 | A * | 5/1990 | Saukkonen et al. | 242/541.3 |
| 5,531,396 | A * | 7/1996 | Kinnunen et al. | 242/526.3 |
| 5,593,545 | A | 1/1997 | Rugowski et al. | |
| 5,901,918 | A | 5/1999 | Klerelld et al. | |
| 5,918,830 | A | 7/1999 | Verajankorva et al. | |
| 5,944,273 | A | 8/1999 | Lin et al. | |
| 6,427,938 | B1 * | 8/2002 | Madrzak et al. | 242/526.3 |
| 6,669,818 | B2 | 12/2003 | Lindén | |
| 6,698,681 | B1 | 3/2004 | Guy et al. | |
| 6,797,115 | B2 | 9/2004 | Klerelid et al. | |
| 6,820,786 | B2 * | 11/2004 | Fleissner | 226/95 |
| 2003/0111199 | A1 | 6/2003 | Clarke et al. | |

FOREIGN PATENT DOCUMENTS

WO WO 2004/110909 A1 12/2004

OTHER PUBLICATIONS

American Society for Testing Materials (ASTM) Designation: D 737-96, "Standard Test Method for Air Permeability of Textile Fabrics," pp. 207-211, published Apr. 1996.

* cited by examiner

*Primary Examiner*—John Q Nguyen
*Assistant Examiner*—William E Dondero
(74) *Attorney, Agent, or Firm*—Gregory E. Croft; Scott A. Baum

(57) ABSTRACT

A reel for winding a paper roll including: a frame supporting a reel drum and a pair of rails; a reel spool supported for translation by the rails and upon which a paper roll is wound; an endless flexible belt wrapping a portion of the periphery of the reel drum and a portion of the periphery of the paper roll; and a loading member for loading the paper roll against the reel drum and the endless flexible belt.

13 Claims, 3 Drawing Sheets

APPARATUS AND METHOD FOR WINDING AND TRANSPORTING PAPER

BACKGROUND

In the manufacture of various types of tissue products such as facial tissue, bath tissue, paper towels and the like, the dried tissue web or tissue sheet coming off of the tissue machine is initially wound into a parent roll by a reel and temporarily stored for further processing. Sometime thereafter, the parent roll is unwound and the tissue web is converted into a final product form.

In winding the tissue web into a large parent roll, it is important that the roll be wound in a manner which prevents major defects in the roll and which permits efficient conversion of the roll into the final product, whether it be boxes of facial tissue sheets, rolls of bath tissue, rolls of embossed paper towels, and the like. Ideally, the parent roll has an essentially cylindrical form, with a smooth cylindrical major surface and two smooth, flat, and parallel end surfaces. The cylindrical major surface and the end surfaces should be free of ripples, bumps, waviness, eccentricity, and wrinkles, i.e. the roll should be substantially uniform. Likewise, the parent roll must be stable, so that it does not depart from its cylindrical shape during storage or routine handling, i.e. the roll should be dimensionally stable. Defects can force entire parent rolls to be scrapped if they are rendered unsuitable for high speed conversion.

Large diameter tissue rolls, having a diameter between about 70 inches to 150 inches, are especially difficult to wind since the tissue sheet is relatively weak, highly compressible, and has a relatively high sheet-to-sheet coefficient of friction. These factors can make it difficult to wind a tight roll with a high wound-in-tension due to nip mechanics. During winding, the layers of a roll will often readjust from the action of the roll moving through the nip to progressively tighten the roll or increase the wound-in-tension. Because the tissue sheet is highly compressible and has a high sheet-to-sheet friction, using a large nip load often deforms the winding parent roll without generating much additional wound-in-tension because the tissue layers do not easily move relative to one another. The large nip load often leads to horse collaring where an outer ring of the roll becomes loose and eventually tears and rips apart. Also, since the tissue is weak, the incoming sheet tension must be kept at a relatively low level, which results in a more loosely wound parent roll having a low wound-in-tension. It is especially important to wind the initial portion of a large diameter roll tightly such that as the diameter and weight of the parent roll increases, the core shaft remains centered within the parent roll and the initial portion is able to support the heavier outer portion of the parent roll without excessive deformation during winding, unwinding, storage, or handling.

New tissue reels having an endless flexible belt, disclosed in U.S. Pat. No. 5,901,918 entitled Apparatus and Method for Winding Paper that issued May 11, 1999 to Klerelid et al., are effective in the winding of tissue and paper webs. Such reels and winding methods can be used to produce substantially uniform and dimensionally stable parent rolls of soft tissue webs having diameters on the order of 70 to 150 inches. Such parent rolls are disclosed in U.S. Pat. No. 5,944,273 entitled Parent Roll for Tissue Paper that issued Aug. 31, 1999 to Lin et al.

However, such reels require a center wind for properly winding the roll. As an example, the pressure in the nip as a result of the increasing roll diameter can vary between approximately 4 psi at the start and reduce to about 0.5 psi with a constant belt tension of approximately 40 lb/in. Since the nip pressure can vary greatly, a center wind is used to better structure the winding roll throughout the entire winding cycle. Furthermore, it can be difficult to obtain a tightly wound roll at the start, since a hard nip between the winding roll and an incompressible drum is not present. Because the existing reel must be replaced rather than retro-fitted, the high capital cost often does not result in a favorable net present value or pay back period to justify the replacement expense.

Conventional pope reels or drum reels are known such as the reel disclosed in U.S. Pat. No 3,743,199 entitled Method and Apparatus for Reeling Web Material that issued Jul. 3, 1973 to Karr et al. These reels have an incompressible drum against which the parent roll is pressed to wind the roll. While winding a large diameter parent roll, often it is not possible to load the roll against the drum with a sufficient force, without damaging the roll, in order to drive the large parent roll without slippage. Too high of a nip load can deform and damage the parent roll and actually results in more force to drive the roll since the roll is highly compressible and readily deformed by the nip load. A possible solution is to use a center wind, but this is an expensive option. Furthermore, existing reels without a center wind may not be convertible to a center wind due to space constraints or the existing design of the current reel.

U.S. Pat. No. 4,143,828 entitled Winder For Papermaking Machine that issued Mar. 13, 1979 to Braun et al. discloses a winder, similar to a pope reel, having an endless band that is used to drive the parent roll. However, the '828 patent fails to teach how to operate the winder to wind a large diameter parent roll. In particular, the patent teaches that the winding roll should preferably not be loaded against the incompressible drum, but rather a gap should be present to allow air to escape through the porous band. It further teaches to change the band tension to change the density of the wound roll. Discussion on the preferred nip load against the reel drum to wind large diameter rolls is not present. A mode of operation using only the belt tension makes it difficult to wind a large diameter parent roll, since the action of the band alone without the use of a center wind can make it difficult to wind a sufficiently tight roll at the start to support the final weight of the large roll.

Another problem with winding tissue is transporting the tissue from the drying cylinder to the reel. U.S. Pat. No. 6,797,115 entitled Method and Apparatus for Making a Creped Tissue With Improved Tactile Qualities While Improving Handling of the Web that issued Sep. 28, 2004 to Klerelid et al. discloses several possible machine configurations using a carrying fabric or belt to transport the tissue to the reel-up. The patent discusses carrying the creped web through a compression nip that compresses the tissue to reduce its thickness and increase its tactile qualities. The patent discusses that as a consequence of the thickness reduction, a lengthening of the web occurs in the machine direction that produces slack in the tissue web on the belt downstream of the compression. The patent further discusses that to avoid winding difficulties in the reel-up, the peripheral speed of the paper roll should exceed that of the belt in order to remove the slack before the tissue web is wound into a roll. The only way that the peripheral speed of the roll can exceed that of the belt is to use a center wind.

Therefore, there is still a need for an apparatus and method of winding paper webs, especially bulky tissue webs, with the ability to wind uniform large diameter parent rolls. There is also need for an apparatus and method of winding paper webs, especially bulky tissue webs, with the ability to wind uniform large diameter rolls using a reel without a center wind assist. There is also a need for an apparatus to transport the paper webs, especially bulky tissue webs, to the reel without excessive compression in order to wind large diameter rolls without a center wind assist.

SUMMARY

These and other needs are met by the apparatus and method for winding large diameter rolls and transporting paper webs according to the present invention. Hence, in one aspect, the invention resides in an apparatus for winding a roll including: a frame supporting a reel drum and a pair of rails; a reel spool supported for translation by the rails and upon which a paper roll is wound; an endless flexible belt wrapping a portion of the periphery of the reel drum and a portion of the periphery of the paper roll; a loading member for loading the paper roll against the reel drum and the endless flexible belt; and wherein the reel drum and endless flexible belt, combined with the action of the loading member, creates a pressure profile on the paper roll having a semi-elliptical initial portion and a linear second portion.

In another aspect, the invention resides in a method of winding a roll by creating a pressure profile on the paper roll having a semi-elliptical initial portion and a linear second portion as the surface of the paper roll traverses the winding nip.

In another aspect, the invention resides in a transfer system for transferring a paper web from a dryer to a reel including: a top lead-in roller, a top exit roller, and a top transfer belt forming an endless loop about both rollers disposed between the dryer and the reel; a bottom lead-in roller, a reel drum, and a bottom transfer belt forming an endless loop about the bottom lead-in roller and the reel drum; the bottom lead-in roller disposed downstream of the top lead-in roller such that the top transfer belt and the bottom transfer belt are sandwiched together for at least a portion of their travel. paths forming a sandwich section; and wherein a nip impulse the paper web is subjected to in the sandwich section is between about 0 PSI*msec to about 8 PSI*msec.

BRIEF DESCRIPTION OF THE DRAWINGS

The above aspects and other features, aspects, and advantages of the present invention will become better understood with regard to the following description, appended claims, and accompanying drawings where:

Figure 1:
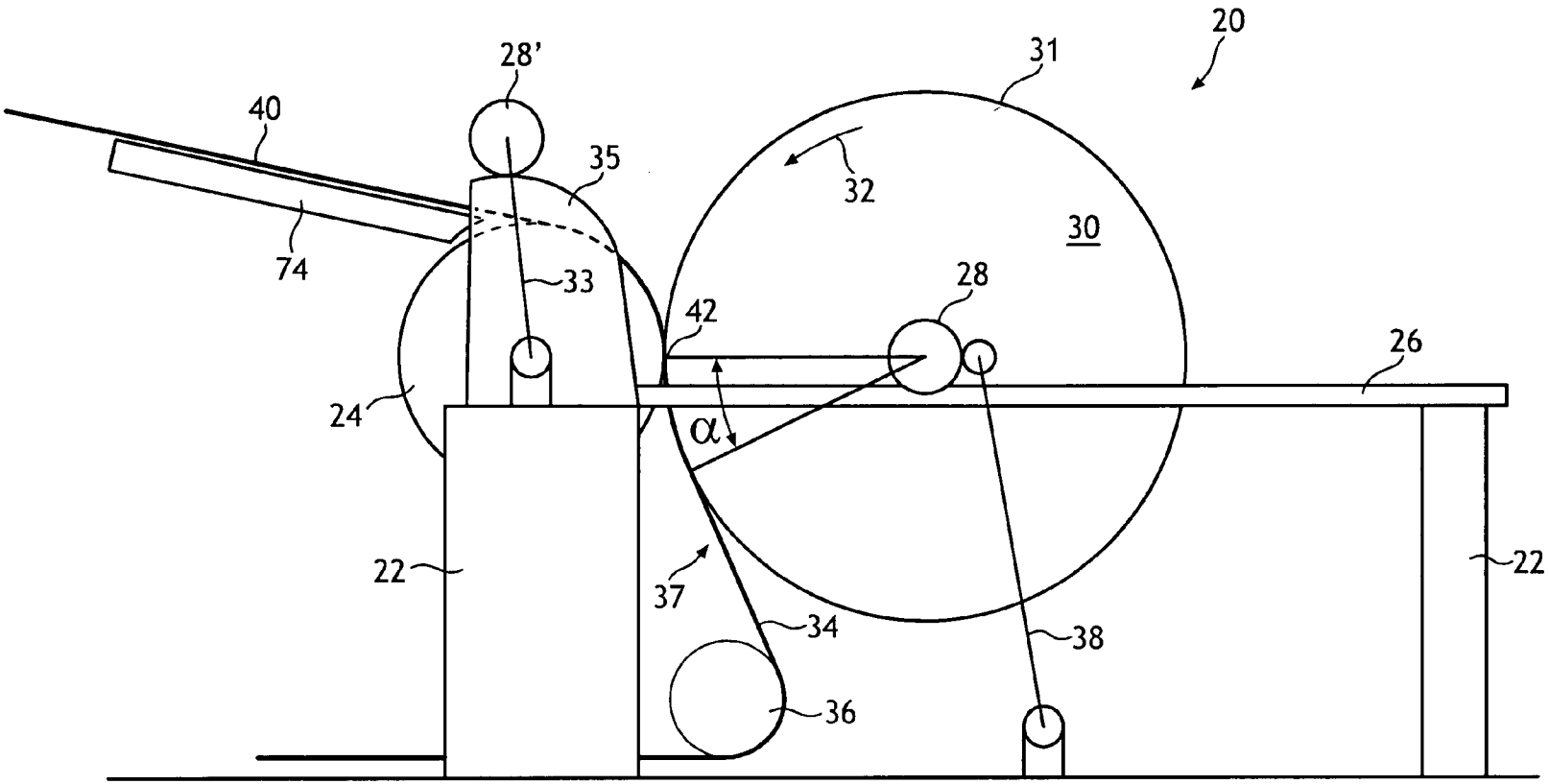
FIG. 1 illustrates a reel in accordance with one embodiment of the invention.

Repeated use of reference characters in the specification and drawings is intended to represent the same or analogous features or elements of the invention.

DEFINITIONS

As used herein "a large diameter roll" is a roll having a diameter greater than about 70 inches, more specifically a roll having a diameter between about 70 inches to about 150 inches, more specifically still, a roll having a diameter between about 70 inches to about 100 inches.

As used herein "linear second portion" refers to the portion of the nip profile obtained between a paper roll and an endless flexible belt wrapping at least a portion of the roll's circumference. The pressure in the linear second portion is a function of belt tension and roll diameter, and has a constant value along the portion of the belt in contact with the roll.

As used herein "semi-elliptical initial portion" refers to the portion of the nip profile obtained between a paper roll and a reel drum when the paper roll is loaded against the reel drum with a sufficient force to create a peak pressure greater than the pressure acting on the roll due to the linear second portion. The pressure profile does not have to be a mathematical semi-elliptical curve, but rather it resembles a semi-elliptical curve. The pressure profile in the semi-elliptical initial portion is a function of the drum diameter, the roll diameter, the drum's modulus, the roll's modulus, and the loading force between the roll and the drum. The Hertzian contact stress formula provides a basis for calculating the length of the semi-elliptical portion of the nip profile. For the purposes of this invention, the semi-elliptical initial portion and the linear second portion are one continuous pressure profile rather than two discrete pressure profiles.

DETAILED DESCRIPTION

It is to be understood by one of ordinary skill in the art that the present discussion is a description of exemplary embodiments only and is not intended as limiting the broader aspects of the present invention, which broader aspects are embodied in the exemplary construction.

Referring to FIG. 1, there is shown in schematic simplified illustration a reel 20 for a paper machine. The reel includes a frame 22 supporting a reel drum 24 and a pair of rails 26. The rails 26 guide a reel spool 28, supported by its journals, for linear translation as a paper roll 30 increases in diameter while being rotated in the direction shown by arrow 32. The reel can also include a set of rotating primary arms 33 that can support a second reel spool 28' in a pre-spin or initial turn-up position. During a turn-up, the reel spool 28' is accelerated up to speed and then guided by a cam 35 into contact with a paper web 40 residing on an endless flexible belt 34 wrapped at least partially around the reel drum 24 for transfer of the paper web onto the new reel spool.

The reel drum is driven by a suitable drive as known to those of skill in the art. The reel spool 28 preferably is not driven by a drive or center wind assist while residing on the rails 26, since the design and operation of the reel, as discussed in more detail to follow, makes such a drive unnecessary. As such, existing pope reels can be readily configured to the illustrated apparatus by the addition of the endless flexible belt 34 and a guide roller 36. The reel spool may be driven by a center wind or a tire acting on a surface of the reel spool while in the primary arms to bring it up to speed as is commonly known.

The reel spool and the winding paper roll are loaded against the reel drum 24 supporting the endless flexible belt 34, and a free span 37 of the endless flexible belt by a loading member 38. In the illustrated embodiment, the loading member 38 was a pair of pivoting secondary arms controlled by hydraulic cylinders; however, linear carriages adjacent the rails 26 or other mechanical loading members known to those of skill in the art can be used.

During operation, the paper web 40 is supported by the endless flexible belt 34 and transported towards the reel drum 24. The paper web 40 is then guided while residing on the endless flexible belt 34 about a portion of the periphery of the reel drum 24 before the nip 42 between the exterior surface 31 of the paper roll 30 and the endless flexible belt residing on the reel drum 24. This portion of the nip, from the prospective of the reel drum/endless flexible belt, is fairly incompressible while the paper roll is compressed and deformed by this "hard nip." For the purposes of this invention, the center line of the hard nip 42 with the reel drum is one end point from which a wrap angle $\alpha$ is determined. The other end point is the tangent where the endless flexible belt 34 diverges from the exterior surface 31 and the endpoint may change as the roll diameter increases. After exiting the hard nip with the reel drum, the endless flexible belt continues to wrap a portion of the periphery of the paper roll 30, before being diverted by guide roller 36 away from the paper roll 30, as shown by wrap angle $\alpha$. The portion of the unsupported endless flexible belt 34 past the reel drum in contact with the exterior surface 31 of the paper roll creates a "soft nip." It is believed that the combination of the hard nip and the soft nip, and, in particular, the specific pressure profile created that allows for the successful winding of large diameter parent rolls.

The endless flexible belt 34 is under tension by a tensioning/guiding system as known to those of skill in the art. As such, the endless flexible belt is rotated by frictional contact with the driven reel drum 24. The paper roll 30 and the reel spool 28 are driven by frictional contact with the endless flexible belt 34 when loaded with a suitable force by the loading member 38. Since the endless flexible belt 34 wraps a significant portion of the paper roll 30, a much lower hard nip can be used while still driving the paper roll without slippage. It is theorized that the power required to drive the paper roll is reduced because of the lower impingement of the reel drum into the paper roll. Thus, a center wind is not needed and the paper roll 30 can be loaded against the reel drum 24 at much lower hard nip loads to prevent horse collaring while still winding a tight roll.

Figure 2:
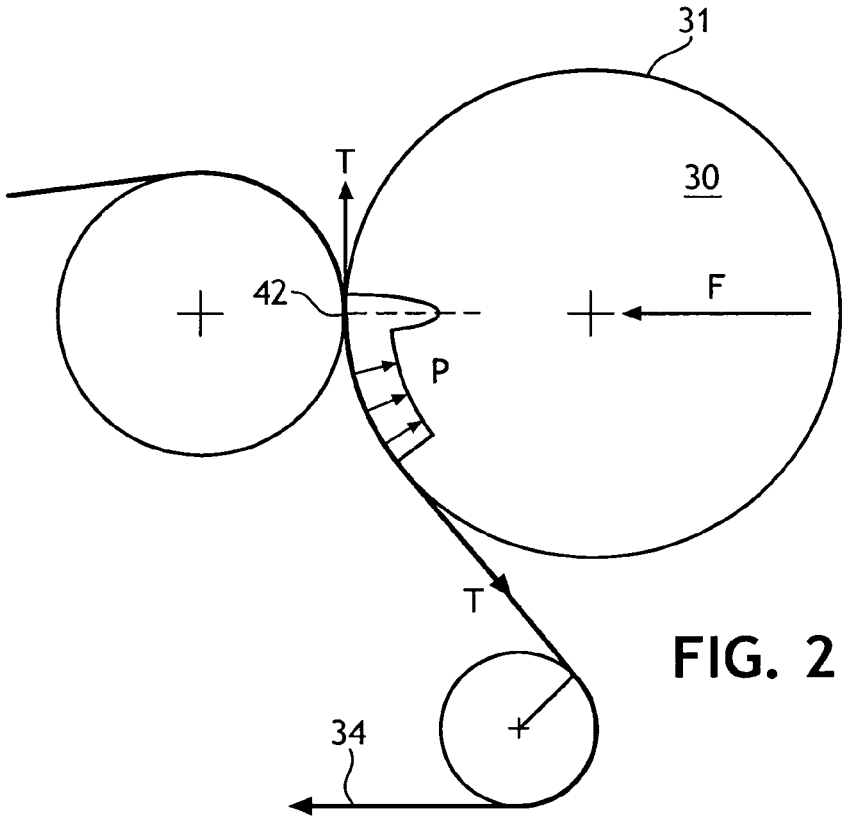
FIG. 2 illustrates a winding nip showing the forces on the roll in the nip.
Figure 3:
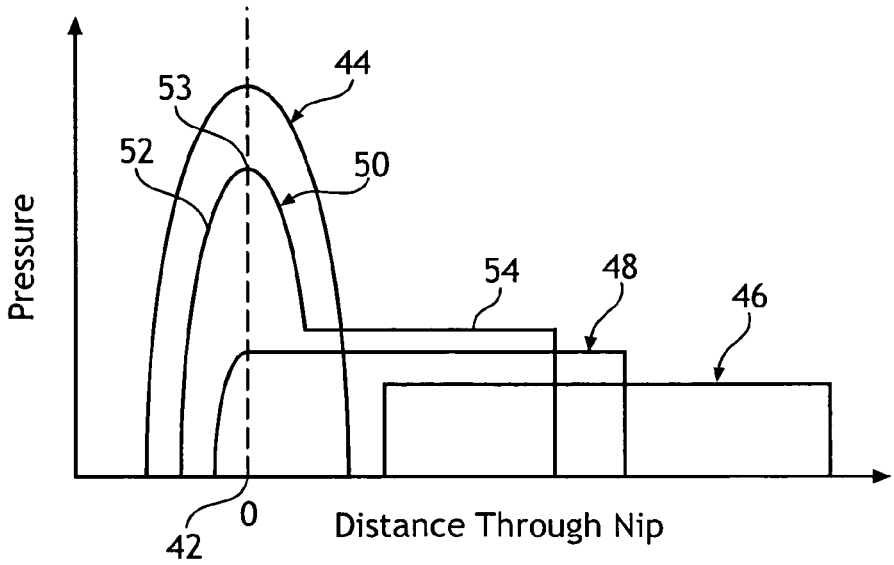
FIG. 3 illustrates a graph of the pressure profile a winding roll is subject to under different winding methods.

Referring now to FIGS. 2 and 3, the forces acting on the paper roll 40 are illustrated in more detail. As seen in FIG. 2, the endless flexible belt 34 is under a variable tension T by the tensioning system while the paper roll 30 has applied a force F by the loading member 38. The two individual forces combine in a pressure profile P that is applied to the exterior surface 31 of paper roll 30. The resulting pressure profile P is shown in more detail in FIG. 3 for various types of winding.

Curve 44 in FIG. 3 illustrates the pressure profile for hard nip winding or a wrap angle $\alpha$ of zero. As seen, the pressure profile is a semi-elliptical curve with the highest pressure located at the center of the hard nip 42. This is the typical pressure profile seen by a paper roll while being wound on a pope reel without an extended belt wrap. In general, to wind large diameter paper rolls, the maximum pressure P required is quite large to ensure adequate traction to drive the paper roll without slippage. As the roll diameter gets large, the loading force F applied to the paper roll must be increased to prevent roll slippage. The use of high loading forces as the roll diameter becomes greater often leads to horse collaring and distorted or poorly wound rolls having a soft or loose initial portion near the core shaft and a rigid or more tightly wound outer portion.

Curve 46 in FIG. 3 illustrates the pressure profile for soft nip winding on the belt where the paper roll is not loaded against the portion of the belt supported by the reel drum and a gap exists between the exterior surface 31 of the paper roll and the reel drum 24. As seen, the pressure through the curve is linear wherever the belt alone is in contact with the roll. The inventors have determined that pure belt winding is not suitable for winding large diameter paper rolls exceeding approximately 70 inches in diameter without the use of a center-wind. In particular, the pressure profile P generated by the endless flexible belt tension alone is too low to wind a tight initial portion of the roll to support the heavy outer portion when the roll diameter exceeds approximately 70 inches in diameter.

Curve 48 in FIG. 3 illustrates the pressure profile for a combination of soft nip winding and light or low levels of hard nip winding where the paper roll is only lightly loaded against the portion of the belt supported by the reel drum. The inventors have determined that low or modest levels of hard nip winding, where the maximum pressure of the hard nip portion is approximately equal to the maximum pressure of the soft nip portion, is not suited for winding large diameter paper rolls exceeding approximately 70 inches in diameter without the use of a center-wind. In particular, the pressure profile P generated is too low to wind a tight initial portion of the roll to support the heavy outer portion when the roll diameter exceeds approximately 70 inches in diameter.

Curve 50 in FIG. 3 illustrates a preferred pressure profile for a combination of hard nip winding and soft nip winding where the paper roll is sufficiently loaded against the reel drum to generate a semi-elliptical initial portion 52 having a higher peak pressure 53 than the pressure of the linear second portion 54 created by the belt's tension alone acting on the paper roll's surface. The inventors have determined that a semi-elliptical initial portion 52 is desired to wind a tight initial start of the roll, but that the maximum peak pressure 53 can be less than that used for pure hard nip winding as shown by curve 44. This provides a good base to the roll at the start of winding to support the outer layers of the web once the roll becomes large. In order to prevent slippage of the paper roll with a reduced hard nip, the pressure generated by the linear second portion 54, in combination with the wrap angle $\alpha$, can be used. As such, the pressure profile P generated curve 50 is ideal to wind a tight initial portion of the paper roll to support the heavier outer portion when the roll diameter exceeds approximately 70 inches in diameter and to do so without slippage.

In different embodiments of the invention for curve 50, the maximum pressure P (53) of the semi-elliptical initial portion 52 can be between about 2 to about 30 lb/in$^2$, or between about 1 to about 15 lb/in$^2$, or between about 1 to about 10 lbs/in$^2$. The pressure P of the linear second portion 54 can be between about 2 to about 10 lb/in$^2$ at the start of the winding cycle reducing to less than about 0.25 lb/in$^2$ at the end of the winding cycle.

The ratio of the maximum pressure P (53) to the pressure of the linear portion can be between about 1.1 to about 4, or between about 1.2 to about 2. The length of the semi-elliptical initial portion 52 is directly related to the force pressing the roll against the drum and the hardness of the roll, while the length of the linear second portion 54 is related to the fabric tension and the radius of the roll. While the maximum pressure P from the hard nip is larger than the pressure P from the linear second portion, the force acting of the roll is often greater from the endless flexible belt due to the larger contact area. The linear loading across the length of the reel spool of the hard nip may range between about 1 to about 3 lb/in, while the linear loading of the soft nip may range between about 2 to about 4 lb/in, or about twice the hard nip loading. As a result, the overall force applied to the roll from the secondary arms can be higher than for a pope reel since a significant part of the force is consumed by overcoming the endless belt tension in the free span to ensure the winding roll contacts the reel drum. This results in higher traction forces driving the paper roll without a large deformation of the winding roll.

To prevent slippage of the paper roll 30, the wrap angle $\alpha$ should be large enough to generate a sufficient tractive force, but not too large so as to unduly impede the interlayer slippage or movement of one paper layer relative to another. The inventors have determined that if the wrap angle becomes too great and a higher belt tension is used, a rather large loading force F must be applied to load the paper roll with sufficient force against the reel drum to create the desired level of the hard nip. In these situations, horse collaring and other roll defects can occur. Also, large wrap angles require large loading forces from the primary arms, which can exceed the loading capability of existing pope reels making a retro-fit impractical without also changing the loading system. In various embodiments of the invention, the wrap angle $\alpha$ can be between about 5 to about 50 degrees, or between about 5 to about 30 degrees, or between about 8 to about 15 degrees.

The tension of the endless flexible belt is generally selected for the best operation of the belt for guiding and stability of travel. Typical tension values are between about 10 lb/in to about 60 lb/in tension. Tensions below 10 pli can lead to difficulty in guiding, and tensions above 60 lb/in are generally beyond the strength capability of normal belting material. In general, a higher belt tension requires a larger loading force from the loading member 38 to force the paper roll into contact with the reel drum to create the hard nip. Too large of a belt tension can exceed the capability of the existing loading member. A belt tension of 25 pli can be used with some existing reels without requiring changes to the loading member. Since the loading member 38 can be used to structure the roll, changing the belt's tension as the roll is winding to achieve a desirable roll structure is typically not needed. It can often be left at a fixed value during the entire winding cycle. However, the belt tension can be changed to influence the paper roll's structure or to compensate for tension variations due to the changing geometry as the paper roll increases in size.

While guide roller 36 has been described as being in one position, there are several advantages to having the ability to change the position of guide roller 36 during operation. By changing the position of the guide roller, the wrap angle $\alpha$ can be changed as the paper roll is being wound. If a harder paper roll 30 is desired, the amount of belt wrap on the paper roll can be reduced thereby increasing the semi-elliptical initial portion of the pressure profile. Conversely, if the web is particularly weak or not resistant to Z-direction forces, the belt wrap on the paper roll can be increased particularly when the winding diameter is above the 70 inch range. The ability to vary the wrap angle $\alpha$ as the paper roll is being wound can improve the runnability and roll structure capability of a reel equipped with the features of this invention.

The endless flexible belt can be impermeable or, preferably, permeable to air flow. A permeable endless flexible belt can be used in conjunction with suitable vacuum equipment for transfer of the paper web onto the endless flexible belt. Air permeability, which is the air flow through a fabric while maintaining a differential air pressure of 0.5 inches of water across the fabric, is tested in accordance with ASTM test method D737-96 entitled "Test Method for Air Permeability of Textile Fabrics." A copy of the test method is available from ASTM International, having an office at 100 Barr Harbor Drive, West Conshohocken, Pa. 19428-2959 USA. To avoid excessive air entrainment to the winding paper roll or paper web instability at the reel drum, the permeability of the endless flexible belt is desirability as low as possible while maintaining adequate sheet contact or the ability to transfer the paper web onto the belt. Suitable air permeability's of the endless flexible belt can be about 175 cfm/ft$^2$ or less, or about 100 cfm/ft$^2$ or less. Suitable endless flexible belts can include an AstenJohnson Permalife E-AJ-175 having an air permeability of approximately 150 cfm/ft$^2$, or an AstenJohnson Permalife K AJ-180 having an air permeability of approximately 80 cfm/ft$^2$.

Figure 4:
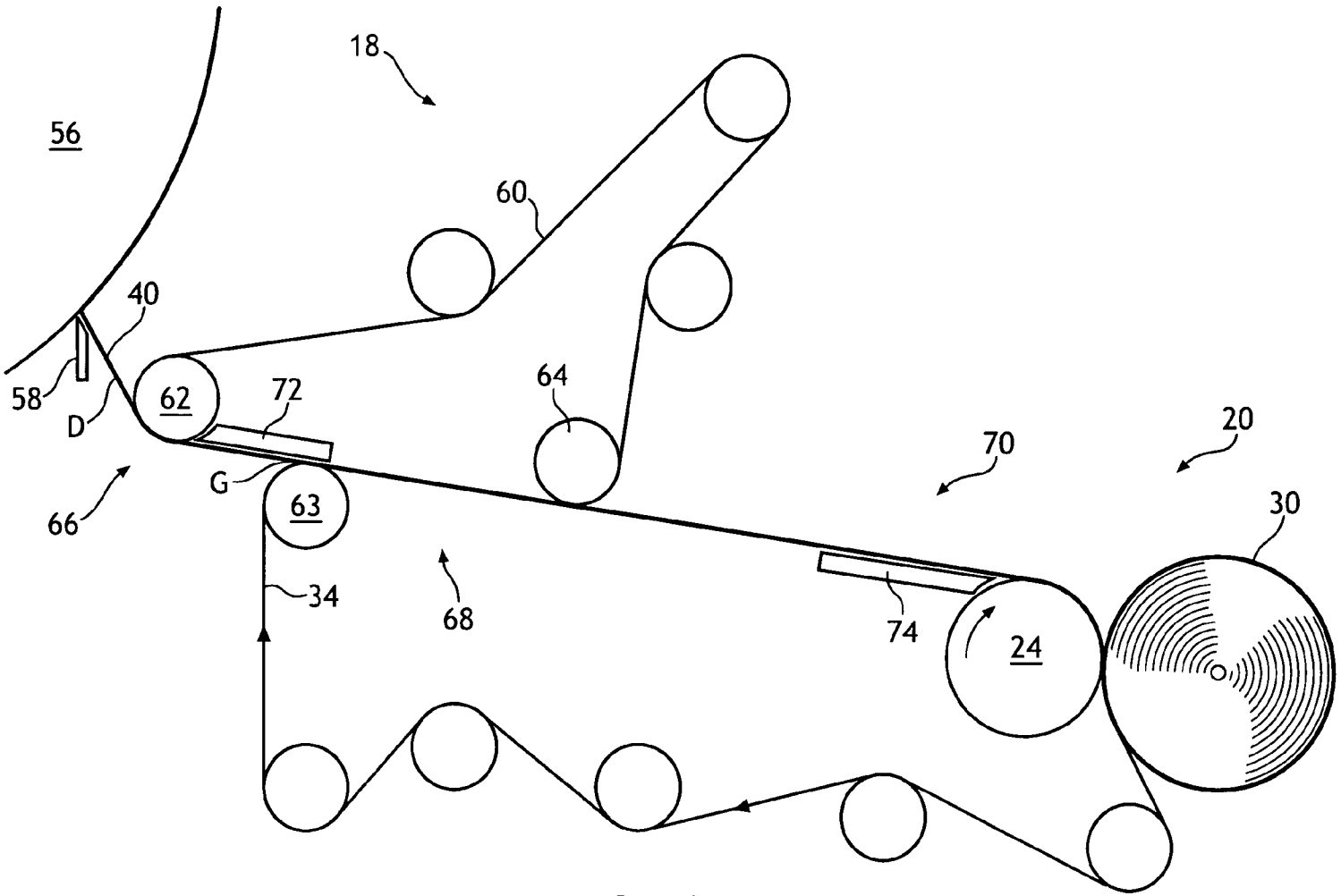
FIG. 4 illustrates a dry end of a paper machine for transporting a paper web to a reel.

Referring now to FIG. 4, a dry end of a tissue machine is shown, and in particular a transfer system 18 for transferring a continuously advancing paper web 40 from a dryer 56 to a reel 20. The illustrated system is suitable for use with various paper machines and is not limited to wet pressed, creped tissue machines. Transfer system 18 is shown with a dryer 56, for example, a Yankee dryer, and a creping doctor 58. The transfer system includes: a top transfer belt 60, an endless flexible belt 34 (bottom transfer belt) which wraps at least a portion of the reel drum 24, a top lead-in roller 62, bottom lead-in roller 63, and a top exit roller 64. Other rollers, as needed, to guide, track, and tension each of the belts can be used as known to those of skill in the art. The top transfer belt at least forms an endless loop about the top lead-in roller and the top exit roller. The bottom transfer belt at least forms an endless loop about the bottom lead-in roller and the reel drum. The various positions of the rollers define a lead-in section 66 for the paper web between the creping doctor 58 and the bottom lead-in roll 63, a sandwich section 68 where the paper web is positioned between the top and bottom belts extending from the bottom lead-in roller 63 to the top exit roller 64, and a scanning section 70 between the top exit roller 64 and the reel drum 24 where the paper web is supported on only one side such that the top surface of the paper web can be scanned by suitable scanning equipment (not shown).

In general, to efficiently transfer the paper web 40 to the reel 20, the top transfer belt 60 and the bottom transfer belt 34 will be air permeable. While the permeability of the two belts can be the same, desirably the permeability of the bottom transfer belt is less than the permeably of the top transfer belt. Such a selection helps to ensure that the paper web 40 will stay affixed to the bottom transfer belt 34 and be conveyed to the reel instead of following the top transfer belt 60 after the two belts diverge at the top exit roller 64. Suitable air permeability for the top transfer belt can be between about 100 cfm/ft$^2$ to about 700 cfm/ft$^2$, or between about 250 cfm/ft$^2$ to about 450 cfm/ft$^2$. Suitable top transfer belts include an AstenJohnson PermaLife-A-AJ-179 having an air permeability of approximately 300 cfm/ft$^2$.

For best transfer characteristics, the permeability of the bottom transfer belt 34 should be between about 50 cfm/ft$^2$ to about 400 cfm/ft$^2$ less than the permeability of the top transfer belt, or the permeability of the bottom transfer belt 34 should be between about 100 cfm/ft$^2$ to about 350 cfm/ft$^2$ less than the permeability of the top transfer belt, or the permeability of the bottom transfer belt 34 should be between about 200 cfm/ft$^2$ to about 300 cfm/ft$^2$ less than the permeability of the top transfer belt.

With regard to the lead-in section 66, the top lead-in roller 62 should be positioned closely to the dryer 56 while still providing sufficient access to the creping doctor 58 and while providing sufficient spacing to allow the tissue to be diverted to a broke conveyor. If the lead-in roller is too close to the dryer, the tissue will always tend to follow the top transfer fabric, making creping blade changes difficult or unpredictable. On the other hand, the shorter the length of the unsupported tissue web, the better the web stability and ease of threading. In general, the draw length D of the unsupported paper web can be between about 4 to about 48 inches, or between about 10 to about 30 inches. A draw length D of approximately 24 inches has been found to provide sufficient clearance and to provide good web stability in the unsupported draw.

To assist with the transfer of the tissue web onto the top transfer belt, the top lead-in roller 62 can be a vacuum roll. Alternatively, a transfer vacuum box 72 can be placed adjacent to the top transfer belt downstream of the top lead-in roller. Alternatively, both a vacuum top lead-in roller and a transfer vacuum box can be used. However, depending on the draw length D and the air permeability of the top transfer belt, the tissue web may transfer with sufficient reliability without the need for a vacuum roller or transfer vacuum box.

While the tissue web is in the lead-in section 66, it is possible to wrap the tissue around supporting rollers or to divert the tissue from a straight line as necessary to direct the tissue to the reel. During such diversion, the tissue is not compressed between two belts resulting in minimal Z-direction (thickness) compression. However, the inventors have determined that it is especially important to minimize the Z-direction compression while the tissue web is sandwiched between the top and bottom transfer belts in the sandwich section 68. Such wrapping and diversion, while in the sandwich section 68, tends to compress the tissue causing it to lose Z-direction bulk (thickness) and to expand or extend in the machine direction. Once the tissue has become extruded in the machine direction, it is especially difficult to wind the tissue at the reel when the reel is not equipped with a center wind assist.

The bottom lead-in roller 63 is disposed downstream or after the top lead-in roller 62 in order to ensure that the tissue broke does not become entangled in a nip between the two rollers and to ensure that the tissue web is not compressed in a nip leading to winding problems. By locating the bottom lead-in roller 63 adjacent to a free span of the top transfer belt, undo Z-direction compression of the tissue web can be minimized.

To further prevent undo Z-direction tissue compression, the inventors have determined that it can be advantageous to have a gap G between the top transfer belt and the bottom transfer belt at least at the bottom lead-in roller. In this embodiment, the top and bottom transfer belts converge as you move downstream from the bottom lead-in roller 63 to the top exit roller 64. Alternatively, the top transfer belt and the bottom transfer belt can be parallel to each other in the sandwich section 68 and separated by a gap G. In general, the gap G should be about equal to or greater than the uncompressed thickness of the paper web. However, to compensate for web flutter and other machine dynamics, the gap G is often much greater than the uncompressed thickness of the paper web. In various embodiments, the gap G can be between about 0.010 inch to about 0.5 inch, or between about 0.015 inch to about 0.1 inch, or between about 0.020 inch to about 0.080 inch.

To further ensure the paper web is not compressed when entering the sandwich section 68, the transfer vacuum box 72 can extend at least to and preferably past the bottom lead-in roller 63. Such a configuration for the transfer vacuum box 72 will help to ensure that the tissue stays adhered to the top transfer belt so as to enter the sandwich section 68 with a gap between the tissue web's lower surface and the bottom transfer belt 34. In general, as long as the tissue is not unduly compressed in the Z-direction, the sandwich section 68 can be extended all the way to the reel drum 24. In practice, it generally does not extend that far to enable a scanner (not shown) to be located in the scanning section 70.

To prevent undo Z-direction compression, the path the top transfer belt 60 and the bottom transfer belt 34, while in the sandwich section 68, (between rollers 63 and 64 including any wrap of the tissue web 40 about the rollers 63 and 64) should be arranged such that the tissue web is not significantly deviated from a substantially straight line by wrapping around a roller while sandwiched between the two belts such that the wrap angle of the outer most belt and its associated tension unduly loads the tissue in the Z-direction. "Substantially straight" does not require a perfectly straight line and some deviation is permitted as long as the tissue web is not unduly compressed by the outer most belt as the tissue web and the two belts wrap a roller.

The Z-direction tissue compression can be approximated by calculating the "nip impulse" the tissue web is subjected to by being deviated from a straight line by wrapping a roller or other sheet control element while being loaded by an outer belt under tension wrapping a portion of a roller with the tissue web being located between the belt and the roller. The concept of a nip impulse has been widely used to describe the calendering effect on a fibrous web, such as a paper web, in a calendering nip. The nip impulse is calculated by multiplying the nip pressure observed by the web in the nip by the dwell time of the web in the nip. The nip impulse then has units of pressure multiplied by time, such as PSI*msec. Referring to FIG. 4, the paper web can be exposed to a calendering effect such as at the bottom lead-in roller 63 and top exit roller 64, if there is a significant wrap of the paper web and the outermost belt around the roller. It has been discovered that it is preferred to minimize this calendering effect in order to maintain tension in the paper web to wind the web without the need for a center wind assist.

As an example, with a top exit roller (64) diameter of 20 inches and a bottom transfer belt 34 tension of approximately 25 pounds per linear inch (PLI), the nip pressure is calculated by dividing the belt tension by the roller radius or 25/10=2.5 pounds per square inch (PSI). When the bottom transfer belt wrapped the top exit roller by a wrap angle of approximately 26 degrees, the wrap distance of the bottom transfer belt 34 around this roller is approximately 4.5 inches. With this wrap distance and a bottom transfer belt speed of approximately 4030 feet per minute, the dwell time of the paper web in this nip is approximately 0.0056 seconds, or 5.6 milliseconds (msec). Multiplying the pressure in PSI by the dwell time yields a nip impulse of approximately 14 PSI*msec. Under these conditions, it was observed that the amount of the calendering effect was too great for winding a paper roll without the need for a center wind assist. Furthermore, it was determined the MD growth or extension of the tissue web under these nip impulse conditions was measured to be approximately 4%. Without being bound by theory, it appears that this level of MD extension reduced the MD tension of the tissue web to the point that it was not always possible to wind a good quality paper roll.

It has now been discovered that it is beneficial to minimize the nip impulse observed by the paper web, such as at rollers 63 and 64, in order to improve the ability to wind good quality parent rolls. It was observed that a calendering nip impulse of approximately 8 PSI*msec enabled the paper roll to be wound without a center wind assist. Thus, in various embodiments of the invention, the nip impulse of the paper web 40 while in the sandwich section 68 can be between about 0 to about 8 PSI*msec, or between about 0 to about 6 PSI*msec, or between about 0 to about 3 PSI*msec.

To ensure a smooth transition of the tissue web off of the top transfer belt, the exit roller 64 can be grooved to allow for improved air flow through the top transfer belt. Suitable grooving can be about ⅛ inch deep by about ¼ inch wide grooves spaced about ½ inch apart. Alternatively, a smooth or non-grooved roller can be used.

After exiting the sandwich section 68, the tissue web is supported only by the bottom transfer belt 34 in the scanning section 70. In general, the length of the scanning section 70 should be minimized to prevent air currents from disrupting the single-side supported tissue web as well as to maintain a flat, planar sheet. Prior to the reel drum 24, an optional reel vacuum box 74 can be located adjacent to the bottom-transfer belt. The reel vacuum box 74 can be used to reduce or eliminate tissue web instability due to boundary layer air that is pumped through the bottom transfer belt by the rotation of the reel drum. Once the tissue web reaches the reel drum, the bottom transfer belt wraps the reel drum and winding roll as shown in FIG. 1 and previously referred to as the endless flexible belt 34. Winding of the paper roll 30 can be done as shown in FIG. 1, or alternatively the bottom transfer belt can wrap only the reel drum such that the paper roll 30 is wound solely with a hard nip. The transfer system 18 can be used with alternative reels other than shown in FIG. 1, including reels with a center-wind assist, but the transfer system as discussed herein is optimized to eliminate the need for a center wind assist.

The advantages of the reel 20 and transport system 18 according to the present invention allow the production of parent rolls of tissue having highly desirable properties. In particular, parent rolls of high bulk tissue can be manufactured having a diameter of about 70 inches or greater and they can be wound without the need for a center wind assist. The inventors have determined that transport system can be used to effectively convey tissue having an MD Slope A of between about 1 kg to about 10 kg, or between about 1 kg to about 5 kg or between about 1 kg to about 3 kg. As the MD Slope A becomes less, the tissue tends to extend or extrude in the MD more when lightly compressed in the Z-direction. Too much extrusion requires a center wind to wind the tissue after it has been extruded.

MD Slope A is computed from the load values of the MD (machine direction) tensile curves, which are obtained under laboratory conditions of 23.0+/−1.0 degrees Celsius and 50.0+/−2.0 percent relative humidity and only after the sheet has equilibrated to the testing conditions for a period of not less than four hours. Testing is done on a constant rate of elongation tensile testing machine. Specimen width is 3 inches. Jaw span (the distance between the jaws, sometimes referred to as gauge length) is 2.0 inches (50.8 mm). Cross-head speed is 10 inches per minute (254 mm/min). A load cell/full scale load is chosen so that the majority of peak load results fall between 20 and 80 percent of the full scale load. The MD Slope A is the two parameter least squares line regression coefficient (sometimes referred to as slope) obtained from the tensile load/elongation curve for all points falling between a load of 70 grams and 157 grams during the ascending part of the curve. The regression coefficient is multiplied by the jaw span and divided by the specimen width to normalize the result, resulting in the final MD Slope A value. The units for MD Slope A are kilograms per 3 inches (7.62 centimeters), but for convenience, the MD Slope A values are hereinafter referred to with units of kg.

Another advantage of the reel 20 and transport system 18 is the resulting improved uniformity in the web properties unwound from the parent roll. Very large parent rolls can be wound without a center wind while still providing substantial web uniformity due to the control of the winding pressure on the web. Another advantage of the method of this invention is that soft, high bulk tissue webs can be wound into parent rolls at high speeds. Suitable machine speeds as measured on the dryer 56 can be from about 3000 to about 6000 feet per minute or greater, more specifically from about 4000 to about 6000 feet per minute or greater, and still more specifically from about 4500 to about 6000 feet per minute.

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part. All cited references, patents, or patent applications in the above application for letters patent are herein incorporated by reference in a consistent manner. In the event of inconsistencies or contradictions between the incorporated references and this application, the information present in this application shall prevail. The preceding description, given by way of example in order to enable one of ordinary skill in the art to practice the claimed invention, is not to be construed as limiting the scope of the invention, which is defined by the claims and all equivalents thereto.

We claim:

1. A reel for winding a paper roll comprising:

a frame supporting a reel drum and a pair of rails;

a reel spool supported for translation by the rails and upon which the paper roll is wound;

an endless flexible bottom transfer belt for transporting a paper web to the paper roll, said bottom transfer belt wrapping a portion of a bottom lead-in roller and a portion of the periphery of the reel drum and a portion of the periphery of the paper roll;

a top transfer belt for transporting the paper web from a dryer and transferring the paper web to the bottom transfer belt, said top transfer belt wrapping a portion of a top lead-in roller and a portion of a top exit roller, such that the paper web is sandwiched between the top transfer belt and the bottom transfer belt in a sandwich section located between the bottom lead-in roller and the top exit roller;

a loading member for loading the paper roll against the reel drum and the bottom transfer belt;

wherein the paper web is not compressed while transported by the top transfer belt;

wherein the paper web is not compressed while transported by the bottom transfer belt; and wherein the reel drum and bottom transfer belt, combined with the action of the loading member, creates a pressure profile on the paper roll having a semi-elliptical initial portion and a linear second portion.

2. The reel of claim 1 wherein the paper roll has a diameter between about 70 inches to about 150 inches.

3. The reel of claim 1 wherein a maximum pressure in the semi-elliptical initial portion is between about 2 to about 30 $lb/in^2$.

4. The reel of claim 1 wherein a maximum pressure in the semi-elliptical initial portion is between about 1 to about 15 $lb/in^2$.

5. The reel of claim 1 wherein the reel does not have a center wind assist.

6. The reel of claim 1 wherein the bottom transfer belt forms a wrap angle $\alpha$, and the wrap angle $\alpha$ is adjusted by moving a guider roller as the paper roll is wound.

7. The reel of claim 1 wherein the paper web in the sandwich section is subjected to a nip impulse between about 0 PSI*msec to about 8 PSI*msec.

8. The reel of claim 1 wherein the paper web in the sandwich section is subjected to a nip impulse between about 0 PSI*msec to about 3 PSI*msec.

9. The reel of claim 1 comprising a gap G between the top transfer belt and the bottom transfer belt at the bottom lead-in roller and the gap G is between about 0.010 inch to about 0.5 inch.

10. The reel of claim 1 comprising a gap G between the top transfer belt and the bottom transfer belt at the bottom lead-in roller and the gap G is between about 0.020 inch to about 0.080 inch.

11. The reel of claim 1 wherein the top transfer belt and bottom transfer belt are air permeable and the permeability of the bottom transfer belt is between about 100 cfm/ft$^2$ to about 350 cfm/ft$^2$ less than the permeability of the top transfer belt.

12. The reel of claim 1 wherein the top transfer belt and the bottom transfer belt are parallel to each other in the sandwich section and separated by a gap G, and the gap G is between about 0.010 inch to about 0.5 inch.

13. The reel of claim 1 comprising a transfer vacuum box located adjacent to the top transfer belt after the top lead-in roller, wherein the transfer vacuum box extends in the machine direction past the bottom lead-in roller.

* * * * *